US005765526A

United States Patent [19]

Hara

[11] Patent Number: 5,765,526

[45] Date of Patent: Jun. 16, 1998

[54] FUEL SUPPLY CONTROL SYSTEM FOR INTERNAL COMBUSTION ENGINES

[75] Inventor: Fumio Hara, Wako, Japan

[73] Assignee: Honda Giken Kogyo Kabushiki Kaisha, Tokyo, Japan

[21] Appl. No.: 787,469

[22] Filed: Jan. 22, 1997

[30] Foreign Application Priority Data

Jan. 22, 1996 [JP] Japan ..... 8-026228

[51] Int. Cl.[6] ..... F02D 33/00

[52] U.S. Cl. ..... 123/333

[58] Field of Search ..... 123/333, 332, 123/198 DB, 325

[56] References Cited

U.S. PATENT DOCUMENTS

| | | | |
|---|---|---|---|
| 4,700,673 | 10/1987 | Denz | 123/333 |
| 4,998,519 | 3/1991 | Kobayashi | 123/333 |
| 5,335,744 | 8/1994 | Takasuka et al. | 123/333 |

FOREIGN PATENT DOCUMENTS 59-90743 5/1984 Japan .

61-66839 4/1986 Japan .

*Primary Examiner*—Thomas N. Moulis

*Attorney, Agent, or Firm*—Nikaiso, Marmelstein, Murray & Oram LLP

[57] ABSTRACT

A fuel supply control system for an internal combustion engine installed in a vehicle has an ECU which controls the amount of fuel to be supplied to the engine according to the rotational speed of the engine detected by a rotational speed sensor and load on the engine detected by a load sensor. The supply of fuel to the engine is interrupted when the detected rotational speed of the engine exceeds a first predetermined value, and the supply of fuel to the engine is resumed when the detected rotational speed of the engine drops below a second predetermined value which is lower than the first predetermined value. When the supply of fuel to the engine is resumed, the air-fuel ratio of a mixture supplied to the engine is leaned by decreasing the amount of fuel to be supplied to the engine, depending on at least one of the detected load on the engine and the detected traveling speed of the vehicle.

6 Claims, 9 Drawing Sheets

START
S1
STARTING MODE?
YES
NO
S28
RESET tmOH
S2
VP SENSOR ABNORMAL ?
YES
NO
S3
tmTDC=0 ?
NO
YES
S4
RESET tmTDC
S5
TW SENSOR ABNORMAL ?
YES
NO
S6
TW>TWOH ?
NO
YES
S7
NE>NEOH ?
NO
S18
RESET tmOH
YES
S8
tmOH=0 ?
NO
YES
S9
FWOT=1 ?
YES
NO
S10
KAFOH←1.0
S19
KAFOH←1.0
CALCULATE KAFOH FROM KAFOH TABLE
S11
KAFOH←1.0
S26
D
A
B
C

FUEL SUPPLY CONTROL SYSTEM FOR INTERNAL COMBUSTION ENGINES

BACKGROUND OF THE INVENTION

1. Field of the Invention

This invention relates to a fuel supply control system for internal combustion engines, and more particularly to a fuel supply control system of this kind, which is capable of preventing overheating of the engine due to overspeed thereof.

2. Prior Art

Conventionally, an internal combustion engine for automotive vehicles, which is equipped with an electronic control fuel injection device, generally employs an engine overheat-preventing system in order to prevent overheating of the engine due to overspeed thereof. According to the conventional overheat-preventing system, fuel supply to the engine is cut off when the rotational speed of the engine exceeds a predetermined value and resumed when the engine rotational speed drops below a predetermined value which is lower than the first-mentioned predetermined value. The conventional overheat-preventing system includes a system which has been proposed, for example, by Japanese Laid-Open Patent Publication (Kokai) No. 61-66839, which progressively lowers a predetermined engine rotational speed value for effecting fuel cut and a predetermined engine rotational speed value for resuming fuel supply to respective lower limit values thereof, when the engine rotational speed exceeds the predetermined engine rotational speed value for effecting fuel cut during racing of the engine, to prevent damage to the engine. Further, to prevent overheating of the engine, a rotational speed control method for internal combustion engines has been proposed, for example, by Japanese Laid-Open Patent Publication (Kokai) No. 59-90743, which leans the air-fuel ratio of an air-fuel mixture supplied to the engine and advances the ignition timing of the engine, when the engine rotational speed exceeds a predetermined value.

These conventional overheat-preventing systems, however, do not contemplate the fact that the temperature of exhaust gases emitted from the engine becomes higher when a throttle valve of the engine has a partial opening than when the throttle valve has a WOT (wide open throttle) opening.

More specifically, during the operation of the engine overheat-preventing system, if the valve opening of the throttle valve is constant, hunting occurs between fuel cut when the engine rotational speed rises above the predetermined value for effecting fuel cut and resumption of fuel supply when the engine rotational speed drops below the predetermined value for resuming fuel supply. During such hunting, the temperature of exhaust gases from the engine is determined by a time period ratio between fuel cut and fuel supply. Assuming that the predetermined engine rotational speed value for effecting fuel cut is constant, the engine rotational speed becomes higher as the throttle valve opening is larger, which leads to an increased volume of exhaust gases so that the temperature of exhaust gases lowers due to the air cooling effect of exhaust gases. On the other hand, the engine rotational speed becomes lower as the throttle valve opening is smaller, and if the engine rotational speed lowers below the predetermined value for resuming fuel supply, fuel supply to the engine is restarted, so that the temperature of exhaust gases increases. Thus, the temperature of exhaust gases assumed when the throttle valve has a partial opening is higher than the temperature assumed when the throttle valve has a WOT opening.

SUMMARY OF THE INVENTION

It is the object of the invention to provide a fuel supply control system for internal combustion engines, which is capable of preventing an increase in the temperature of exhaust gases from the engine even when the throttle valve has a partial opening, to thereby exhibit improved overheat-preventing performance.

To attain the above object, the present invention provides a fuel supply control system for an internal combustion engine installed in a vehicle, comprising:

rotational speed-detecting means for detecting rotational speed of the engine;

load-detecting means for detecting load on the engine;

fuel supply means for supplying fuel to the engine;

vehicle speed-detecting means for detecting traveling speed of the vehicle fuel supply control means for controlling an amount of fuel to be supplied to the engine by the fuel supply means, according to the rotational speed of the engine detected by the rotational speed-detecting means and the load on the engine detected by the load-detecting means, the fuel supply control means interrupting supply of fuel to the engine by the fuel supply means when the rotational speed of the engine detected by the rotational speed-detecting means exceeds a first predetermined value, and resuming the supply of fuel to the engine by the fuel supply means when the rotational speed of the engine detected by the rotational speed-detecting means drops below a second predetermined value which is lower than the first predetermined value; and leaning means operable when the fuel supply control means resumes the supply of fuel by the fuel supply means to the engine, for leaning an air-fuel ratio of a mixture supplied to the engine by decreasing the amount of fuel to be supplied to the engine by the fuel supply means, depending on at least one of the load on the engine detected by the load-detecting means and the traveling speed of the vehicle detected by the vehicle speed-detecting means.

Preferably, the leaning means increases a degree of leaning of the air-fuel ratio of the mixture as the traveling speed of the vehicle detected by the vehicle speed-detecting means is lower.

Also preferably, the leaning means increases the degree of leaning of the air-fuel ratio of the mixture as the load on the engine detected by the load-detecting means is smaller.

More preferably, the fuel supply control system includes leaning-terminating means for terminating operation of the leaning means when the load on the engine detected by the load-detecting means is larger than a predetermined value.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
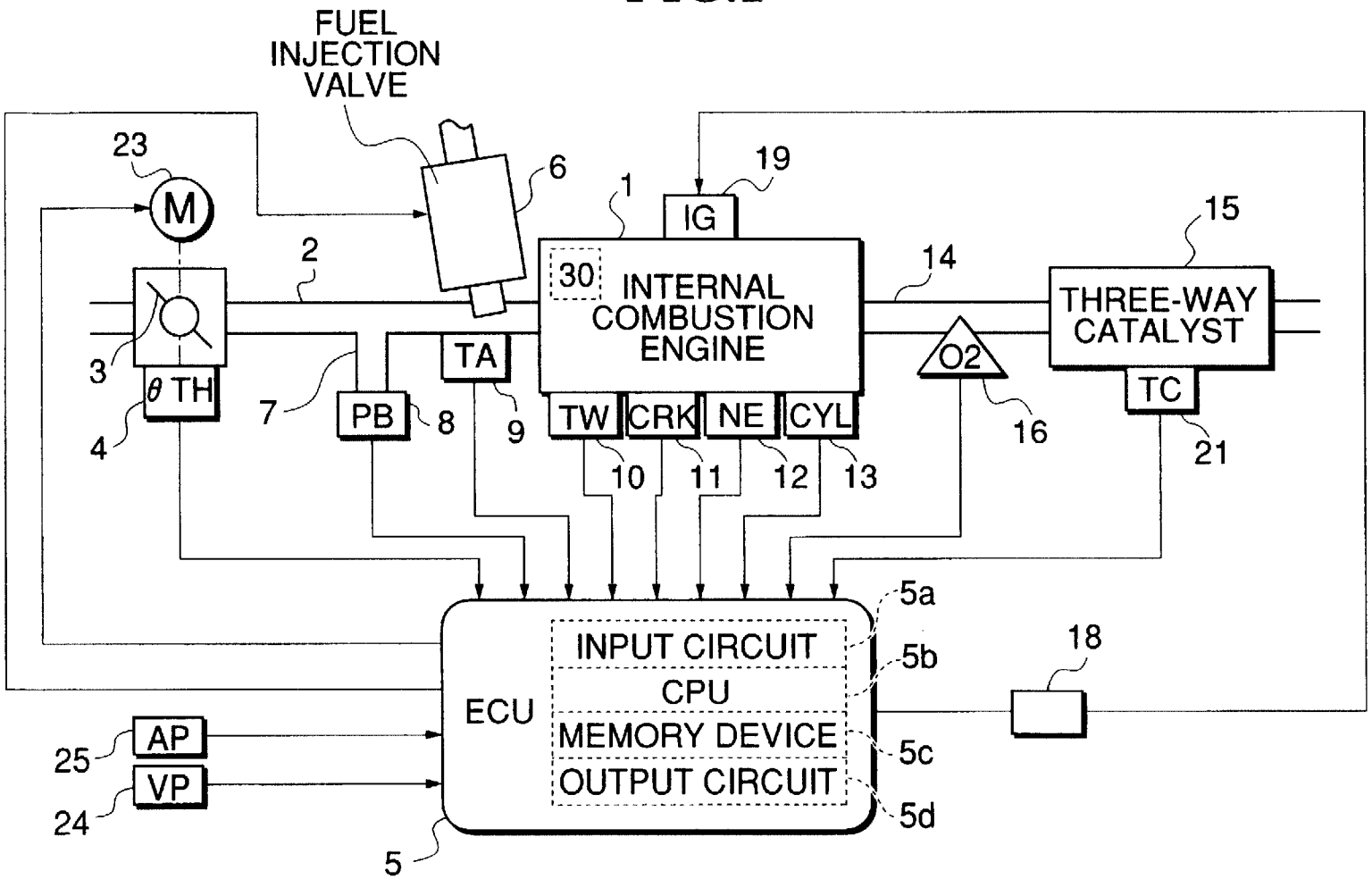
FIG. 1 is a block diagram showing the whole arrangement of an internal combustion engine incorporating a fuel supply control system therefor, according to an embodiment of the invention.

Referring first to FIG. 1, there is shown the whole arrangement of an internal combustion engine incorporating a fuel supply control system therefor, according to an embodiment of the invention.

In the figure, reference numeral 1 designates an internal combustion engine (hereinafter simply referred to as "the engine") of a DOHC straight four-cylinder type, each cylinder being provided with a pair of intake valves and a pair of exhaust valves, none of which are shown. The engine 1 has a valve timing changeover device 30 which changes valve timing (valve operative state, such as valve lift and valve opening period) of the intake valves and exhaust valves between a high-speed valve timing suitable for operation of the engine in a high rotational speed region and a low-speed valve timing suitable for operation of the engine in a low rotational speed region.

The valve timing changeover device 30 is electrically connected to an electronic control unit (hereinafter referred to as "the ECU") 5 to be selectively controlled to the high-speed valve timing and the low-speed valve timing in response to operating conditions of the engine. Further, a sensor, not shown, is electrically connected to the ECU 5, which detects abnormality of the device 30 as well as the selected valve timing.

Connected to the cylinder block of the engine 1 is an intake pipe 2 in which is arranged a throttle valve 3. A throttle valve opening (θTH) sensor 4 as load-detecting means is connected to the throttle valve 3, for generating an electric signal indicative of the sensed throttle valve opening TH and supplying the same to the ECU 5.

Further connected to the ECU 5 are a throttle actuator 23 for driving the throttle valve 3, and an accelerator pedal opening (AP) sensor 25 for detecting the accelerator pedal opening AP of an accelerator pedal, not shown, of an automotive vehicle in which the engine 1 is installed. The ECU 5 is supplied with an electric signal indicative of the sensed accelerator pedal opening AP, and drives the throttle actuator 23, based on the accelerator pedal opening AP.

Fuel injection valves 6, only one of which is shown, are inserted into the interior of the intake pipe 2 at locations intermediate between the cylinder block of the engine 1 and the throttle valve 3 and slightly upstream of respective corresponding intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 as load-detecting means is provided in communication with the interior of the intake pipe 2 via a conduit 7 opening into the intake pipe 2 at a location immediately downstream of the throttle valve 3, for supplying an electric signal indicative of the sensed absolute pressure PBA within the intake pipe 2 to the ECU 5. An intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1 which is filled with engine coolant, for supplying an electric signal indicative of the sensed engine coolant temperature TW to the ECU 5.

A cylinder-discriminating sensor (hereinafter referred to as "the CYL sensor") 13, an engine rotational speed (NE) sensor 12, and a crank angle sensor (hereinafter referred to as "the CRK sensor") 11 are arranged in facing relation to a camshaft or a crankshaft of the engine 1, neither of which is shown. The CYL sensor 13 generates a signal pulse (hereinafter referred to as "a CYL signal pulse") at a predetermined crank angle position of a particular cylinder of the engine 1, and the NE sensor 12 as rotational speed-detecting means generates a signal pulse (hereinafter referred to as "a TDC signal pulse") at one of predetermined crank angle positions (e.g. whenever the crankshaft rotates through 180 degrees when the engine is of a four-cylinder type) which corresponds to a predetermined crank angle before a top dead point (TDC) of each cylinder corresponding to the start of the intake stroke of the cylinder. The CRK sensor 11 generates a signal pulse (hereinafter referred to as "a CRK signal pulse") at each of predetermined crank angle positions whenever the crankshaft rotates through a predetermined angle (e.g. 30 degrees) with a predetermined repetition period shorter than the repetition period of TDC signal pulses. The CYL signal pulse, the TDC signal pulse, and the CRK signal pulse are supplied to the ECU 5.

Each cylinder of the engine 1 has a spark plug 19 electrically connected to the ECU 5 via a distributor 18. Further electrically connected to the ECU 5 is a vehicle speed sensor 24 for detecting the traveling speed VP of the vehicle.

A three-way catalyst (catalytic converter) 15 is arranged in an exhaust pipe 14 connected to the cylinder block of the engine 1, for purifying noxious components present in exhaust gases, such as HC, CO, and NOx. An oxygen concentration sensor (hereinafter referred to as "the 02 sensor") 16 as an air-fuel ratio sensor is mounted in the exhaust pipe 14 at a location upstream of the three-way catalyst 15, for sensing the concentration of oxygen present in exhaust gases emitted from the engine 1 and supplying an electric signal indicative of the sensed oxygen concentration to the ECU 5. Further, a catalyst temperature sensor 21 is connected to the three-way catalyst 15, for supplying an electric signal indicative of the sensed catalyst temperature to the ECU 5.

The ECU 5 is comprised of an input circuit **5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5b, a memory device 5*c* storing various operational programs which are executed by the CPU 5*b*, and for storing results of calculations therefrom, etc., and an output circuit 5*d* which outputs driving signals to the fuel injection valves 6, the distributor 18**, etc.

The CPU 5b operates in response to the above-mentioned signals from the sensors to determine various operating conditions in which the engine 1 is operating, such as an air-fuel ratio feedback control region in which the air-fuel ratio of a mixture supplied to the engine 1 is controlled in response to the detected oxygen concentration in exhaust gases, and open-loop control regions other than the air-fuel ratio feedback control region, and calculates, based upon the determined operating conditions, the valve opening period or fuel injection period Tout over which the fuel injection valve 6 is to be opened in synchronism with generation of TDC signal pulses, by the use of the following equation (1):

$$Tout=Ti\times KO2\times K1+K2 \quad (1)$$

where Ti represents a basic value of the fuel injection period TOUT, which is determined in accordance with the engine rotational speed NE and the intake pipe absolute pressure PBA. A Ti map for use in determining the Ti value is stored in the memory device 5c.

KO2 represents an air-fuel ratio feedback control correction coefficient which is determined in response to an output from the 02 sensor 16 such that the detected air-fuel ratio becomes equal to a stoichiometric value during air-fuel ratio feedback control, while it is set to respective predetermined values while the engine is in the open-loop control regions.

K1 and K2 represent other correction coefficients and correction variables, respectively, which are calculated based on various engine operating parameter signals to such values as to optimize characteristics of the engine such as fuel consumption and engine accelerability depending on operating conditions of the engine. The correction coefficients K1 include a leaning coefficient KAFOH, hereinafter referred to.

The CPU 5b further calculates the ignition timing θIG, based on the determined operating conditions of the engine, and outputs, via the output circuit 5d, driving signals for driving the fuel injection valves 6 according to the calculated Tout value, and driving signals for driving the spark plugs 19 according to the calculated ignition timing θIG.

Figure 2:
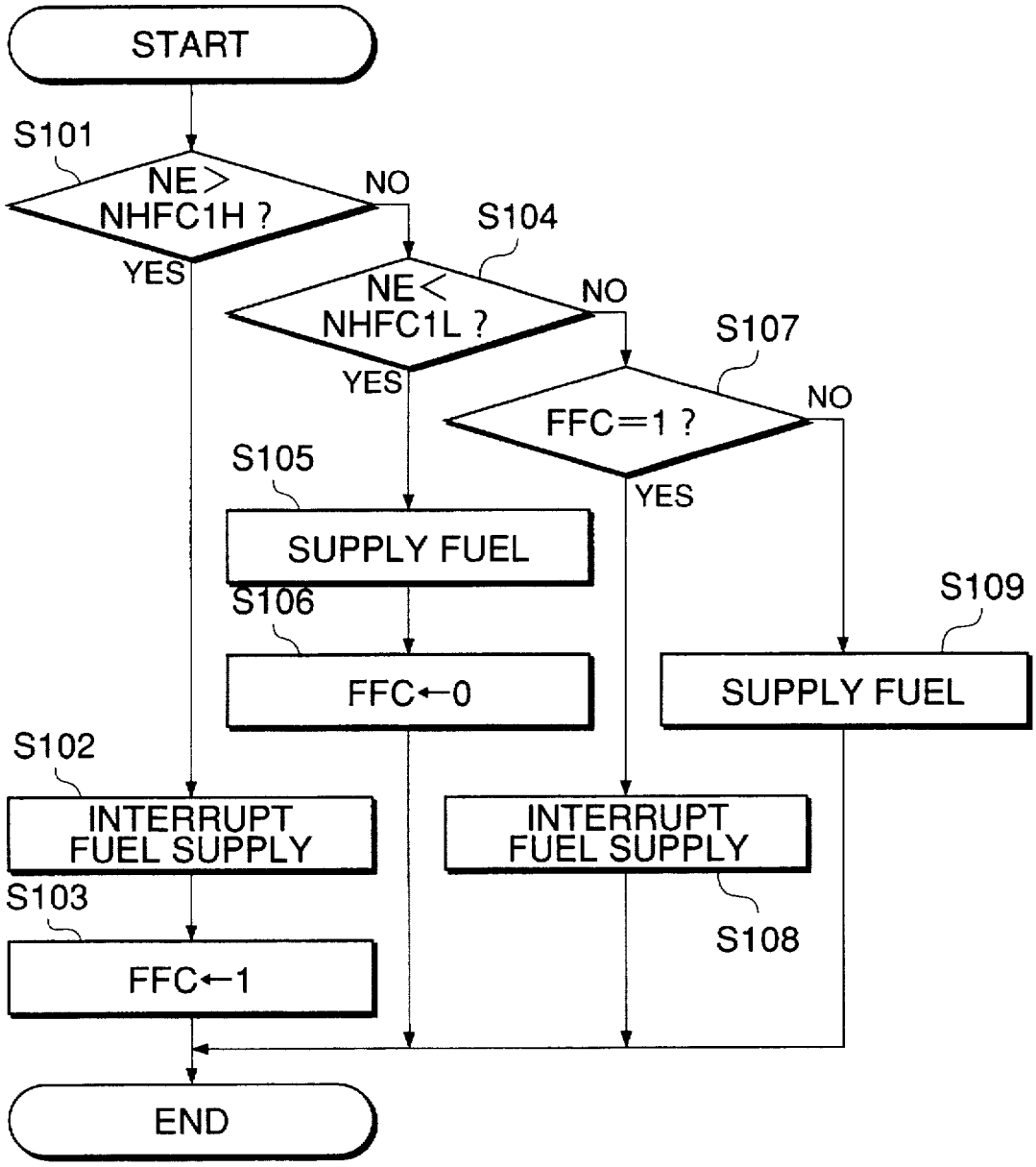
FIG. 2 is a flowchart showing a program for carrying out fuel cut control according to the embodiment.

FIG. 2 shows a program for carrying out fuel cut control according to the embodiment.

According to the present processing, to prevent overheating of the engine 1 due to overspeed thereof, fuel supply to the engine 1 is cut off when the engine rotational speed NE exceeds a predetermined fuel cut rotational speed NHFC1. This predetermined fuel cut rotational speed NHFC1 is provided with hysteresis, i.e., a fuel cut-effecting rotational speed value NHFCLH (e.g. 6500 rpm or 7700 rpm) applied when the engine rotational speed NE rises, and a fuel cut-terminating rotational speed value NHFC1L (e.g. 6200 rpm or 7500 rpm) applied when the engine rotational speed NE lowers. That is, fuel cut is carried out when the engine rotational speed NE rises across the fuel cut-effecting rotational speed value NHFC1H, while fuel supply is resumed when the engine rotational speed NE lowers across the fuel cut-terminating rotational speed value NHFC1L.

Similarly, other engine rotational speeds as determining values, hereinafter referred to, will be suffixed with H/L if they are provided with hysteresis.

First, at a step S101, it is determined whether or not the engine rotational speed NE exceeds the fuel cut-effecting rotational speed value NHFC1H, and if the NE value exceeds the fuel cut-effecting rotational speed value NHFC1H, fuel supply is cut off at a step S102, and then a flag FFC which, when set to "0", indicates that the engine 1 is in a fuel supply state, is set to "1" at a step S103, followed by terminating the present routine.

If the engine rotational speed NE is equal to or lower than the fuel cut-effecting rotational speed value NHFC1H, the program proceeds to a step S104, wherein it is determined whether or not the engine rotational speed NE is below the fuel cut-terminating rotational speed value NHFC1L. If NE<NHFC1L holds, fuel supply to the engine 1 is resumed at a step S105, and then the flag FFC is set to "0" at a step S106, followed by terminating the present routine.

If the NE value exceeds the fuel cut-terminating rotational speed value NHFCLL at the step S104, the program proceeds to a step S107, wherein it is determined whether or not the flag FFC is equal to "1". If FFC=1 holds, the fuel cut state of the engine 1 is maintained at a step S108, followed by terminating the present routine. On the other hand, if FFC=0 holds, the fuel supply state is maintained at a step S109, followed by terminating the present routine.

According to the present embodiment, to prevent overheating of the engine 1 due to overspeed thereof, if the engine rotational speed NE exceeds the predetermined fuel cut engine rotational speed NHFC1H/L, the rotational speed value NHFC1H/L is progressively lowered to its lower limit value. More specifically, progressive lowering of the fuel cut engine rotational speed NHFC1H/L is carried out according to a program shown in FIGS. 3A and 3B for calculating the fuel cut engine rotational speed NHFC1H/L. The present program is executed by the CPU 5b at predetermined time intervals.

In the following description, the fuel cut engine rotational speed NHFC1 is referred to as NHFC1H/L, because the present program carries out calculation of the fuel cut-effecting rotational speed value NHFC1H and calculation of the fuel cut-terminating rotational speed value NHFC1L in the same manner with each other, and hence the same description can be used to explain the manners of calculating the two speed values NHFC1H and NHFC1L.

First, at a step S1, it is determined whether or not the engine 1 is in a starting mode. If the answer is negative (NO), the program proceeds to a step S2, wherein it is determined whether or not the vehicle speed (VP) sensor 24 is abnormal. If the vehicle speed (VP) sensor 24 is not abnormal, it is determined at a step S3 whether or not the count value of a down-counting timer tmTDC for inhibiting a change in the fuel cut engine rotational speed NHFC1H/L is determined to be equal to 0. The count value of the timer tmTDC is set to a predetermined value, e.g. 100 msec. After setting of the timer tmTDC, execution of a step S4 et seq. is inhibited until the count value of the timer tmTDC becomes equal to 0 to avoid frequent change of the fuel cut engine rotational speed NHFC1H/L.

If the count value of the timer tmTDC is determined to be equal to 0 at the step S3, which means that the time period for inhibiting a change in the fuel cut engine rotational speed NHFC1H/L has elapsed, the count value of the timer tmTDC is reset to the predetermined value at the step S4. Then, it is determined at a step S5 whether or not the engine coolant temperature (TW) sensor 10 is abnormal. If the answer is negative (NO), the program proceeds to a step S6, wherein it is determined whether or not the engine coolant temperature TW exceeds a predetermined value TWOH (e.g. 50° C.) for engine overheat-determination.

If the engine coolant temperature TW is determined to exceed the predetermined value TWOH at the step S6, the program proceeds to a step S7, wherein it is determined whether or not the engine rotational speed NE exceeds a predetermined value NEOHH/L for engine overheating determination. The predetermined engine rotational speed NEOH is also provided with hysteresis, similarly to the fuel cut engine rotational speed NHFC1, i.e. a rotational speed value NEOHH (e.g. 6000 rpm) applied when the engine rotational speed NE rises, and a rotational speed value NEOHL (e.g. 3000 rpm) applied when the engine rotational speed NE lowers.

If it is determined at the step S7 that the engine rotational speed NE exceeds the predetermined value NEOHH/L, the program proceeds to a step S8, wherein it is determined whether or not the count value of a change delay timer tmOH for the fuel cut engine rotational speed NHFC1H/L is equal to 0. The count value of the delay timer tmOH is set to a predetermined time period, e.g. 60 sec. If the count value of the delay timer tmOH is determined to be equal to 0 at the step S8, which means that the predetermined time period has elapsed, the program proceeds to a step S9.

The delay timer tmOH is reset at steps S18 and S28, referred to hereinafter. More specifically, if the engine 1 is not in the starting mode at the step S1, the engine coolant temperature TW exceeds the predetermined value TWOH at the step S6, the engine rotational speed NE exceeds the predetermined value NEOHH/L at the step S7, and at the same time the engine rotational speed NE exceeds the predetermined value NEOHH/L, execution of the step S9 et seq. is inhibited until the count value of the timer tmOH becomes equal to 0.

At the step S9, it is determined whether or not a flag FWOT which, when set to "1", indicates that the throttle valve has a WOT opening, is equal to "1". If the flag FWOT is equal to "1", the leaning coefficient KAFOH is set to 1.0 at a step S10, whereas if the flag FWOT is not equal to "1", the leaning coefficient KAFOH is determined at a step S11, from a leaning coefficient KAFOH table shown in FIG. 4, which is set according to the vehicle speed VP. The leaning coefficient KAFOH is employed as a correction coefficient by which is multiplied the fuel injection period Tout of the fuel injection valve 6. According to the KAFOH table, if the vehicle speed VP is equal to or below a predetermined value VFC1, the leaning coefficient KAFOH is set to a value below 1.0, and accordingly the fuel injection period Tout of the fuel injection valve 6 is decreased, to thereby lean the air-fuel ratio. On the other hand, if the vehicle speed VP exceeds the predetermined value FVC1, the leaning coefficient is set equal to 1.0, and accordingly the fuel injection period Tout is not decreased, to thereby inhibit leaning of the air-fuel ratio.

By thus setting the leaning coefficient inhibiting leaning KAFOH to 1.0 to thereby inhibit leaning of the air-fuel ratio, it is possible to avoid the driveability from being spoiled due to leaning of the air-fuel ratio during normal traveling of the vehicle such as cruising. The reason why the degree of leaning of the air-fuel ratio is increased as the vehicle speed VP is lower when the vehicle speed VP is equal to or lower than the predetermined value VFC1 is based on the fact that when the vehicle is suddenly accelerated from a lower traveling speed, the temperature of exhaust gases become higher as the vehicle speed VP is lower, as well as on the fact that the temperature of exhaust gases is generally higher when the vehicle is standing than when it is traveling.

Figure 5:
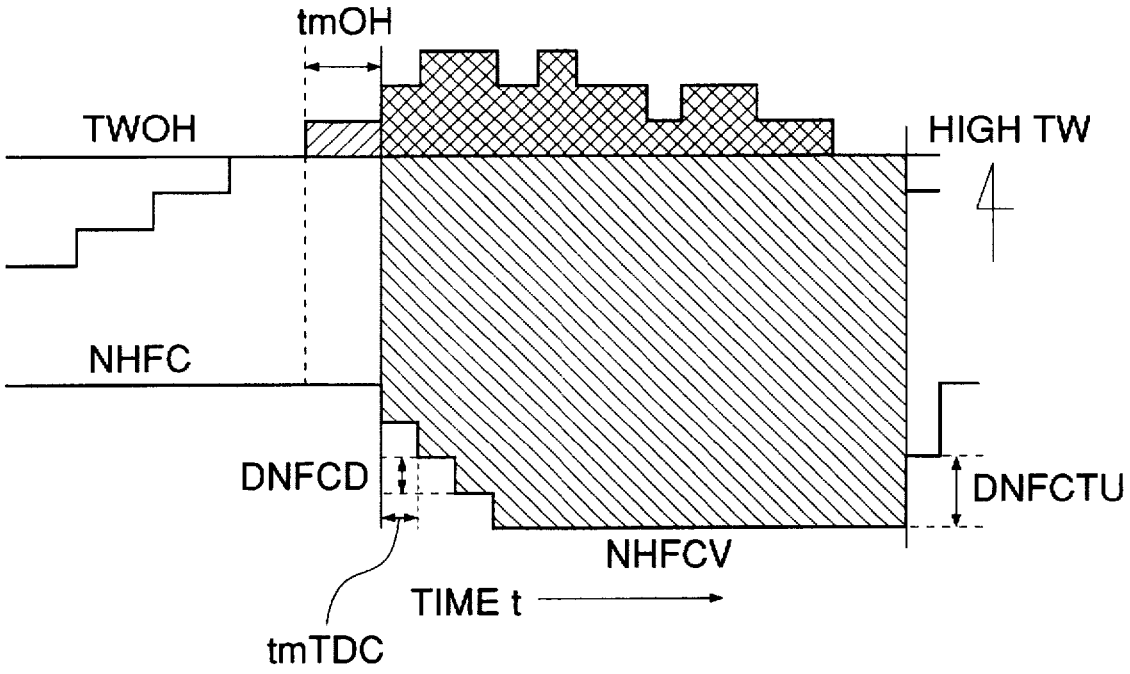
FIG. 5 is a graph useful in explaining how the fuel cut engine rotational speed NHFC1H/L is controlled.

After execution of the step S10 or S11, the program proceeds to a step S12, wherein a predetermined decrement DNFCD is subtracted from the fuel cut engine rotational speed NHFC1H/L, and the resulting value is set to a new value of the NHFC1H/L value. The predetermined decrement DNFCD is set, e.g. to 23.3 rpm. As a result, the fuel cut engine rotational speed is progressively decreased, as shown in FIG. 5 showing changes in the fuel cut engine rotational speed NHFC1H/L.

Then, it is determined at a step S13 whether or not the valve timing is set to the high-speed valve timing. If the valve timing is set to the high-speed valve timing, the program proceeds to a step S14, wherein a value of a fuel cut engine rotational speed NHFCVH/L suitable for the high-speed valve timing is determined from a solid line 81 or 82 in an NHFCV table.

On the other hand, if the valve timing is set to the low-speed valve timing, the program proceeds to a step S15, wherein a value of a fuel cut engine rotational speed NHFCVH/L suitable for the low-speed valve timing is determined from the solid line 81 or 82 in the NHFCV table.

Figure 6:
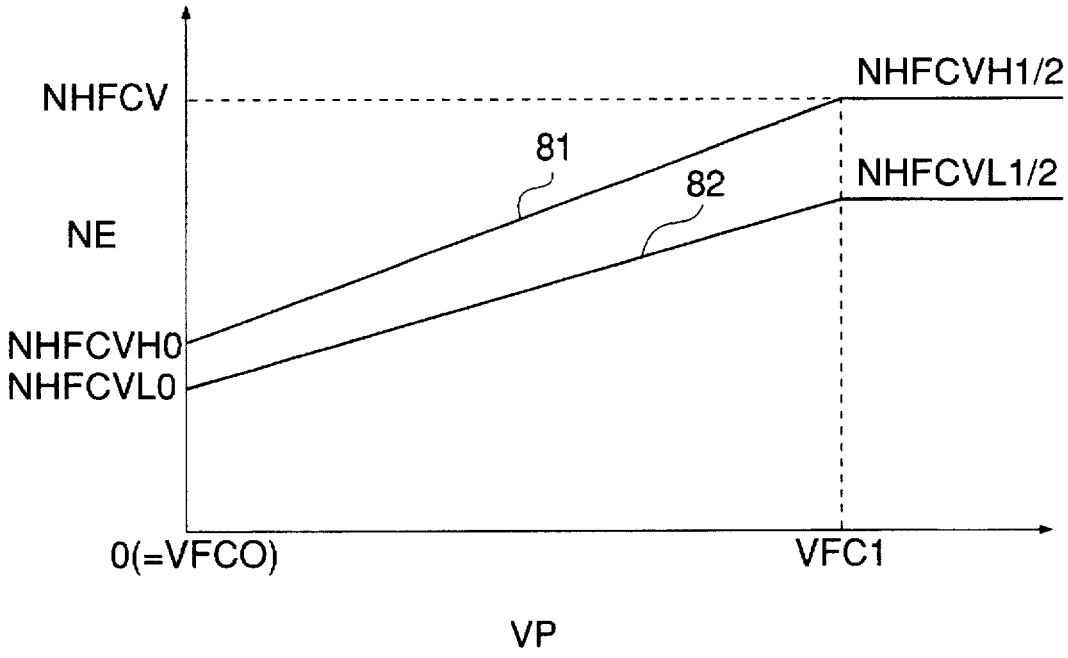
FIG. 6 shows tables for determining a fuel cut engine rotational speed NHFCVH/L dependent upon valve timing of intake valves and/or exhaust valves.

Also the fuel cut engine rotational speed lower limit NHFCV is provided with hysteresis. In FIG. 6, NHFCVH represents a fuel cut-effecting rotational speed value, and NHFCVL a fuel cut-terminating rotational speed value. Further, symbol 1/2 of the values NHFCVH1/2 and NHFCVL1/2 indicate that the value is for the low speed valve timing or for the high speed valve timing. That is, 1 of 1/2 means that the value is for the low speed valve timing, and 2 means that the value is for the higher speed valve timing. In the figure, the solid line 81 depicts a single line representative of a change in the fuel cut-effecting rotational speed value as being suitable for both the high-speed valve timing and the low-speed valve timing for the sake of convenience, though the actual values of the values NHFCVH1 and NHFCVH2 are different from each other. This is the same with the solid line 82. In the following description the symbols 1/2 will be omitted from the values NHFCVH1/2 and NHFCVL1/2 for the sake of convenience.

Referring again to FIG. 3B, after execution of the step S14 or S15, the program proceeds to a step S16, wherein it is determined whether or not the fuel cut engine rotational speed NHFC1H/L is equal to or higher than the fuel cut engine rotational speed NHFCVH/L. If the former is lower than the latter, the program proceeds to a step S17, wherein the fuel cut engine rotational speed NHFC1H/L is set to the fuel cut engine rotational speed NHFCVH/L, followed by terminating the present routine.

On the other hand, if the fuel cut engine rotational speed NHFC1H/L is equal to or higher than the fuel cut engine rotational speed NHFCVH/L at the step S16, the fuel cut engine rotational speed NHFC1H/L is maintained as it is, followed by terminating the present routine. In this manner, the fuel cut engine rotational speed NHFCVH/L determined based on the present vehicle speed VP value is set as the lower limit value for the fuel cut engine rotational speed NHFC1H/L.

On the other hand, if it is determined at the respective steps S6 and S7 that the engine coolant temperature TW is equal to or lower than the predetermined value TWOH or the engine rotational speed NE is equal to or lower than the predetermined value NEOHH/L, the delay timer tmOH is reset at the step S18.

If the timer tmOH is reset at the step S18, or the count value of the timer tmOH is determined not to be equal to 0 at the step S8, the leaning coefficient KAFOH is set to 1.0 at a step S19, and then at a step S20, a predetermined increment DNFCU is added to the fuel cut engine rotational speed NHFC1H/L to thereby obtain a new value of the fuel cut engine rotational speed NHFC1H/L. The predetermined increment DNFCU is set, e.g. to 675 rpm.

Thus, the fuel cut engine rotational speed NHFC1H/L is progressively increased, as shown in FIG. 5.

At a step S21, it is determined whether or not the valve timing is set to the high-speed valve timing. If the answer is affirmative (YES), the program proceeds to a step S22, wherein a value of the fuel cut engine rotational speed NHFCVH/L suitable for the high-speed valve timing is determined from the solid line 81 or 82 in the NHFCV table.

On the other hand, if the valve timing is set to the low-speed valve timing, the program proceeds to a step S23, wherein a value of the fuel cut engine rotational speed NHFCVH/L suitable for the low-speed valve timing is determined from the solid line in the NHFCV table.

After execution of the step S22 or S23, the program proceeds to a step S24, wherein it is determined whether or not the fuel cut engine rotational speed NHFC1H/L is equal to or higher than the fuel cut engine rotational speed NHFCVH/L. If the answer is affirmative (YES), the program proceeds to the step S17, wherein the fuel cut engine rotational speed NHFC1H/L is set to the fuel cut engine rotational speed NHFCVH/L, followed by terminating the present routine.

If it is determined at the step S24 that the fuel cut engine rotational speed NHFC1H/L is below the fuel cut engine rotational speed NHFCVH/L, the fuel cut engine rotational speed NHFC1H/L is maintained as it is, followed by terminating the present routine. In this manner, the fuel cut engine rotational speed NHFCVH/L determined based on the present vehicle speed VP value is set as the upper limit value for the fuel cut engine rotational speed NHFC1H/L.

Further, if it is determined at the step S3 that the count value of the timer tmTDC is not equal to 0, it means that the time period for inhibiting a change in the fuel cut engine rotational speed NHFC1H/L has not elapsed, and therefore the present routine is terminated.

Further, if it is determined at the step S2 that the vehicle sensor 10 is abnormal, the vehicle speed is regarded as a value larger than the predetermined value VFC1 and the valve timing is assumed to be set to the low-speed valve timing for fail-safe operation. Therefore, the leaning coefficient KAFOH is set to 1.0at a step S26, and the fuel cut engine rotational speed NHFC1H/L is set to the value NHFCVH/L1 of the fuel cut engine rotational speed NHFCVH/L suitable for the low-speed valve timing at a step S27, followed by terminating the present routine.

If it is determined at the step S1 that the engine operating condition is in the starting mode, the timer tmOH is reset at a step S28, and then the steps S26 and S27 are executed, followed by terminating the present routine.

According to the present embodiment described above, during operation of the engine overheat-preventing system, the air-fuel ratio is leaned according to the vehicle speed VP. As a result, even when the throttle valve TH has a partial opening, the temperature of exhaust gases from the engine can be prevented from rising, to thereby achieve improved overheat-preventing performance.

Next, a variation of the above described embodiment will be described with reference to FIGS. 7 and 8.

Figure 3A:
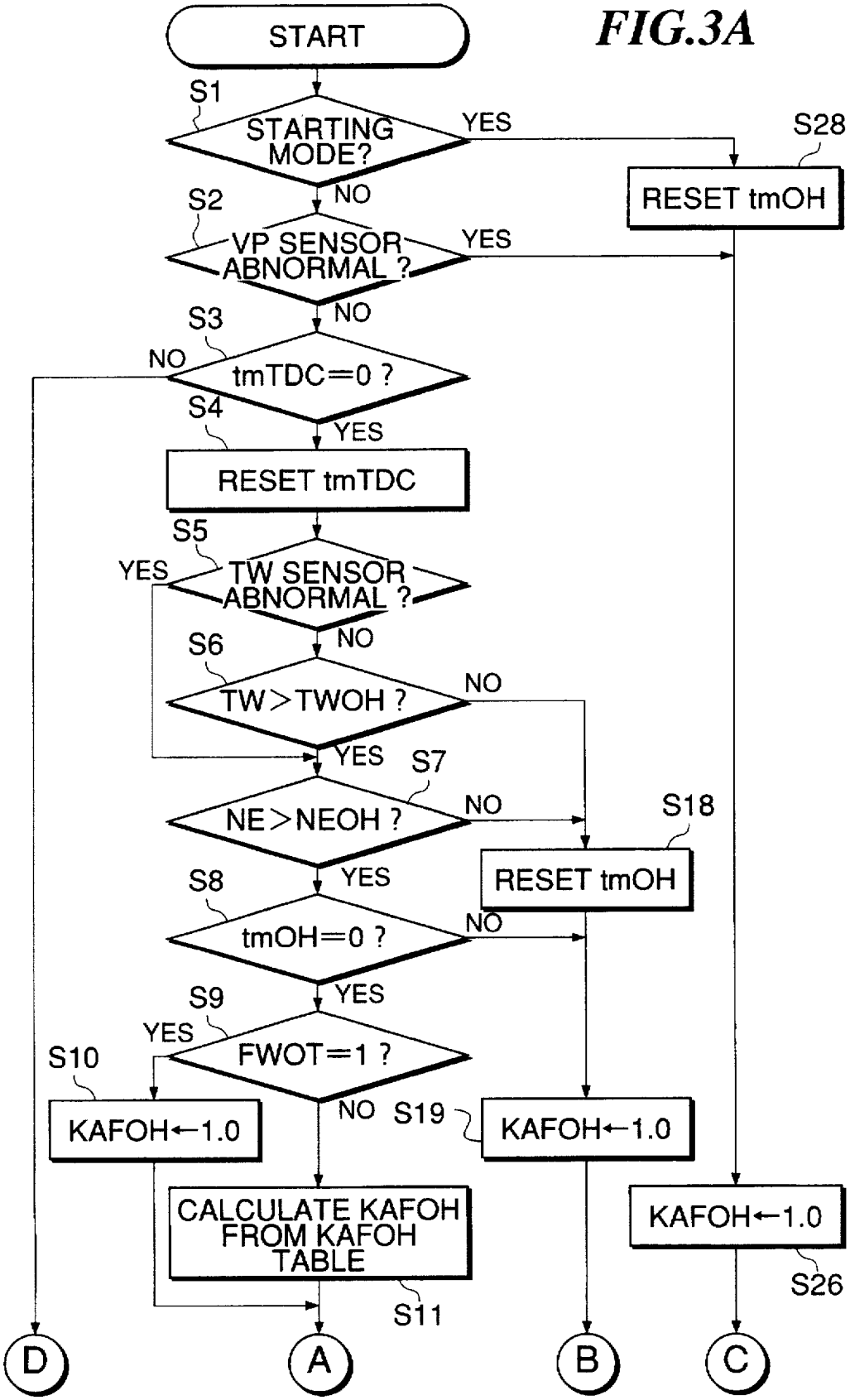
FIG. 3A is a flowchart showing a program for calculating a fuel cut engine rotational speed NHFC1H/L for prevention of overspeed of the engine.
Figure 3B:
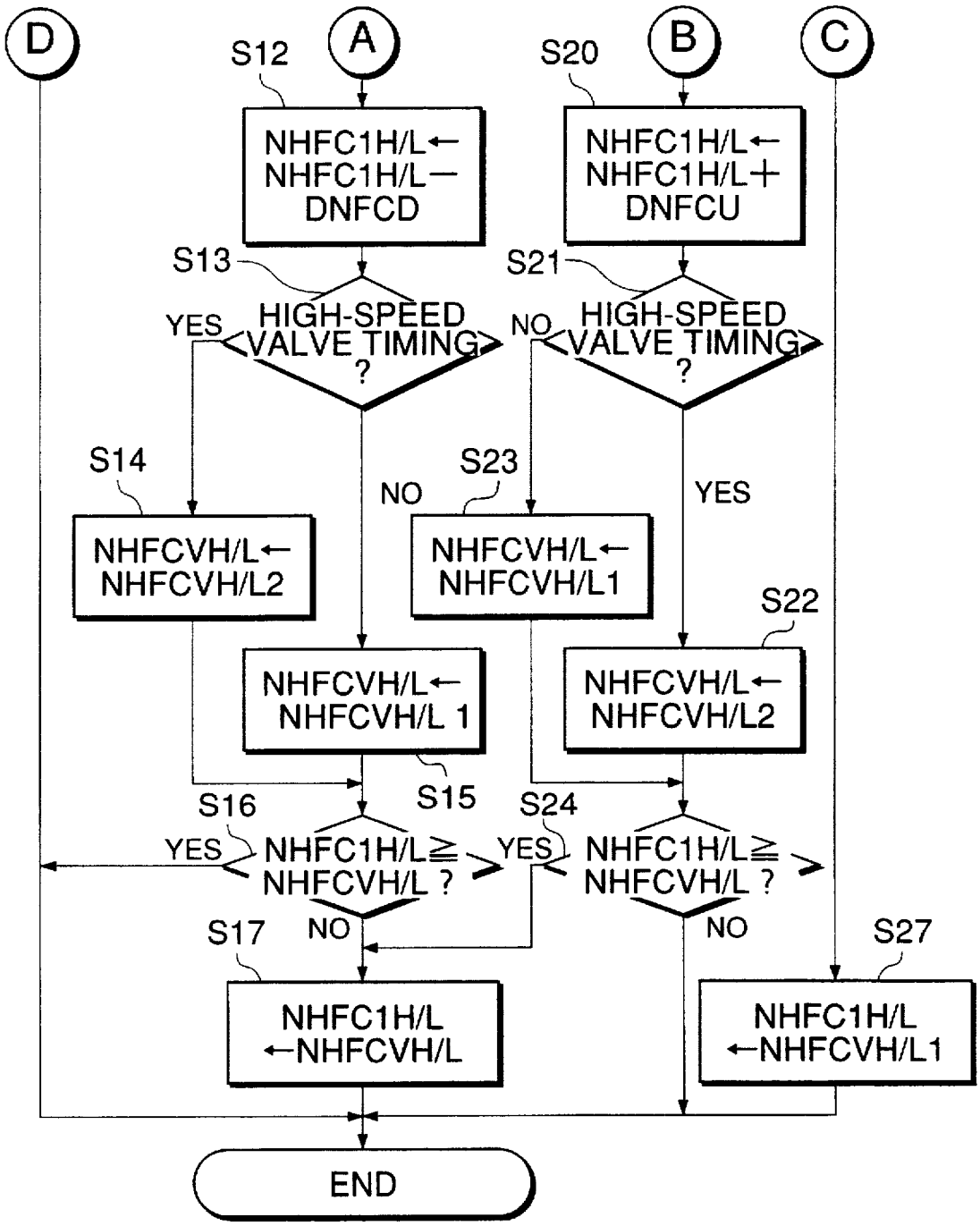
FIG. 3B is a continued part of the flowchart of FIG. 3A.
Figure 7:
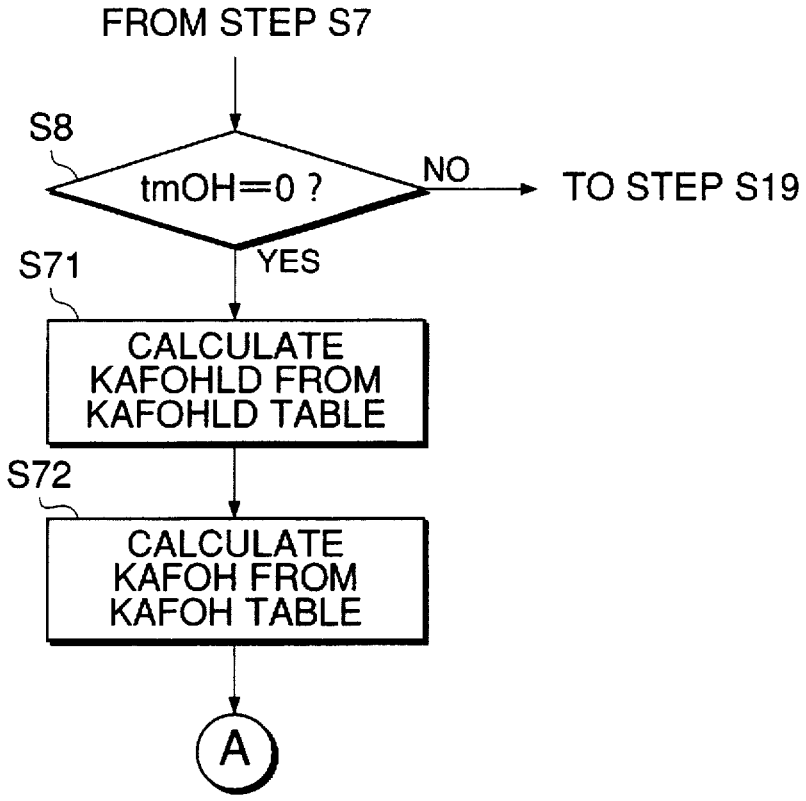
FIG. 7 is a fragmental flowchart showing a part of a program for calculating leaning coefficients, according to a variation of the embodiment.

In the present variation, in place of the steps S9 to S11 in FIG. 3A, steps S71 and S72 in FIG. 7 are executed for calculating leaning coefficients.

Figure 4:
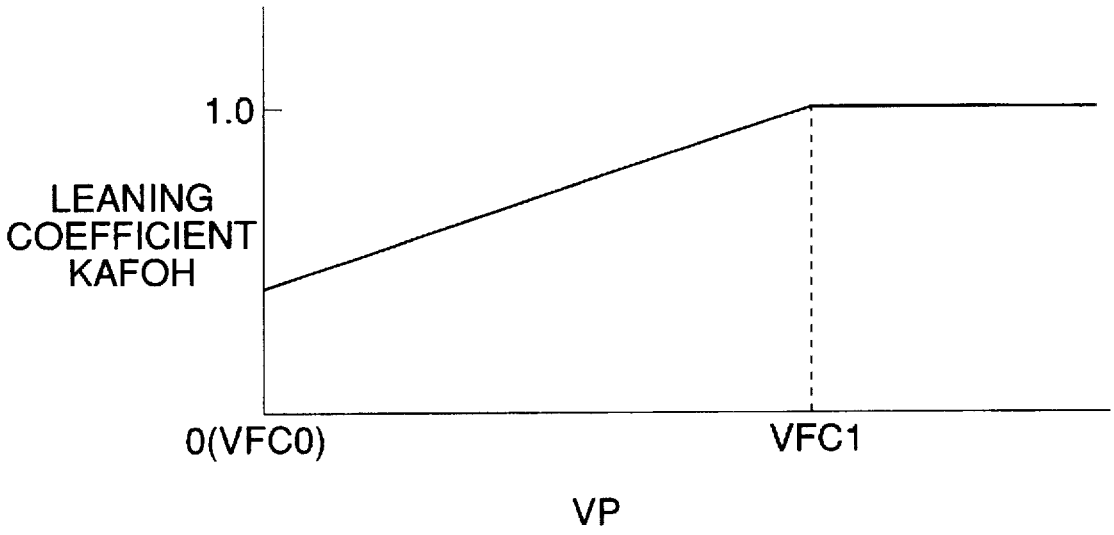
FIG. 4 shows a table which is used for determining a leaning coefficient KAFOH according to the vehicle speed VP.
Figure 8:
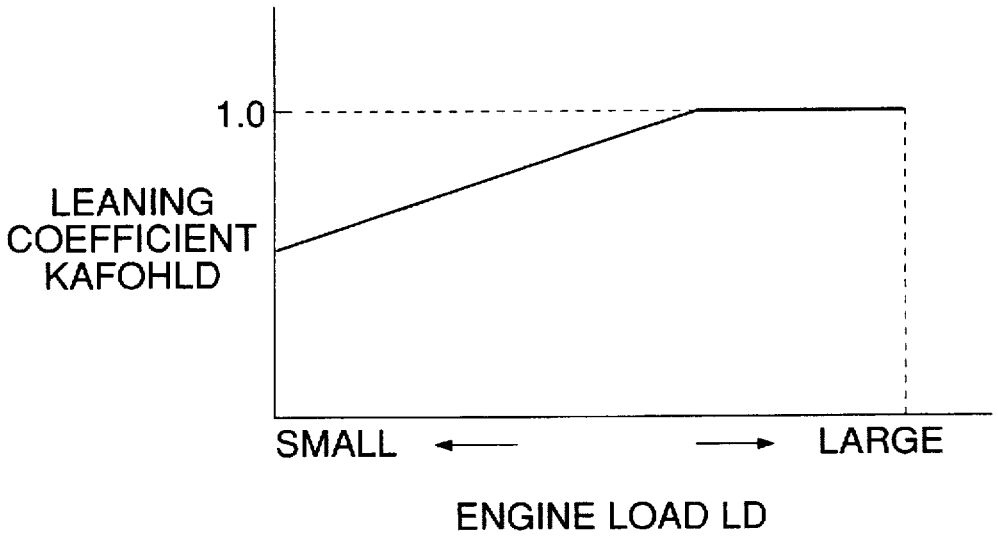
FIG. 8 shows a table for determining a leaning coefficient KAFOHLD according to load LD on the engine.

More specifically, if it is determined at the step S8 that the count value of the timer tmOH becomes equal to 0, the program proceeds to a step S71, wherein a KAFOHLD table for determining a leaning coefficient KAFOHLD, shown in FIG. 8, is retrieved according to load LD on the engine, which is obtained from the throttle valve opening θTH or the intake pipe absolute pressure PBA, to thereby determine the leaning coefficient KAFOHLD. Then, at a step S72, the leaning coefficient KAFOH is determined from the KAFOH table of FIG. 4 according to the vehicle speed VP. These leaning coefficients KAFOHLD and KAFOH are employed to multiply the fuel injection period Tout of the fuel injection valve 6 thereby. According to the KAFOHLD table of FIG. 8, if the load LD on the engine is smaller than a predetermined value, the leaning coefficient KAFOHLD is set smaller than 1.0. As stated before, according to the KAFOH table of FIG. 4, if the vehicle speed VP is smaller than the predetermined value VFC1, the leaning coefficient KAFOH is set smaller than 1.0. When the coefficients are both set smaller than 1.0, the fuel injection period Tout is decreased, to lean the air-fuel ratio. On the other hand, if the load LD on the engine exceeds the predetermined value, the leaning coefficient KAFOHLD is set to 1.0, as shown in FIG. 8, and if the vehicle speed VP exceeds the predetermined value VFC1, the leaning coefficient KAFOH is set to 1.0, as shown in FIG. 4. In this case, the fuel injection period Tout is not decreased and hence the air-fuel ratio is not leaned.

According to the present variation, during operation of the engine overheat-preventing system, the air-fuel ratio is leaned according to the load LD on the engine and the vehicle speed VP. As a result, even when the throttle valve θTH has a partial opening, the temperature of exhaust gases from the engine can be prevented from rising, to thereby achieve improved overheat-preventing performance.

In another variation of the embodiment, only the leaning coefficient KAFOHLD may be determined according to the load LD on the engine while execution of the step S72 is omitted, to thereby calculate the fuel injection period Tout by using the coefficient KAFOHLD alone as a correction coefficient.

What is claimed is:

1. A fuel supply control system for an internal combustion engine installed in a vehicle, comprising:

rotational speed-detecting means for detecting rotational speed of said engine;

load-detecting means for detecting load on said engine;

fuel supply means for supplying fuel to said engine;

vehicle speed-detecting means for detecting traveling speed of said vehicle fuel supply control means for controlling an amount of fuel to be supplied to said engine by said fuel supply means, according to said rotational speed of said engine detected by said rotational speed-detecting means and said load on said engine detected by said load-detecting means, said fuel supply control means interrupting supply of fuel to said engine by said fuel supply means when said rotational speed of said engine detected by said rotational speed-detecting means exceeds a first predetermined value, and resuming said supply of fuel to said engine by said fuel supply means when said rotational speed of said engine detected by said rotational speed-detecting means drops below a second predetermined value which is lower than said first predetermined value; and leaning means operable when said fuel supply control means resumes said supply of fuel by said fuel supply means to said engine, for leaning an air-fuel ratio of a mixture supplied to said engine by decreasing said amount of fuel to be supplied to said engine by said fuel supply means, depending on at least one of said load on said engine detected by said load-detecting means and said traveling speed of said vehicle detected by said vehicle speed-detecting means.

2. A fuel supply control system as claimed in claim 1, wherein said leaning means increases a degree of leaning of said air-fuel ratio of said mixture as said traveling speed of said vehicle detected by said vehicle speed-detecting means is lower.

3. A fuel supply control system as claimed in claim 1, wherein said leaning means increases a degree of leaning of said air-fuel ratio of said mixture as said load on said engine detected by said load-detecting means is smaller.

4. A fuel supply control system as claimed in claim 2, wherein said leaning means increases said degree of leaning of said air-fuel ratio of said mixture as said load on said engine detected by said load-detecting means is smaller.

5. A fuel supply control system as claimed in claim 3, including leaning-terminating means for terminating operation of said leaning means when said load on said engine detected by said load-detecting means is larger than a predetermined value.

6. A fuel supply control system as claimed in claim 4, including leaning-terminating means for terminating operation of said leaning means when said load on said engine detected by said load-detecting means is larger than a predetermined value.

* * * * *